United States Patent [19]

Campbell et al.

[11] 4,201,840

[45] May 6, 1980

[54] PHOTOGRAPHIC FILM UNITS CONTAINING A POLYMERIC MORDANT WHICH COVALENTLY BONDS WITH CERTAIN DYES

[75] Inventors: Gerald A. Campbell, Webster; Hyman Cohen, Hilton; Lewis R. Hamilton; George Villard, both of Rochester, all of N.Y.

[73] Assignee: Eastman Kodak Company, Rochester, N.Y.

[21] Appl. No.: 13,858

[22] Filed: Feb. 22, 1979

Related U.S. Application Data

[60] Division of Ser. No. 906,289, May 15, 1978, which is a continuation-in-part of Ser. No. 839,879, Oct. 6, 1977, abandoned.

[51] Int. Cl.[2] ..... G03C 1/40; G03C 1/48; G03C 1/06; G03C 1/10

[52] U.S. Cl. ..... 430/17; 430/213; 430/545; 430/559; 430/566

[58] Field of Search ..... 96/67, 76 R, 77, 84 R, 96/84 UV, 95, 96, 99, 100, 114, 107, 109, 111, 120, 101

[56] References Cited

U.S. PATENT DOCUMENTS

| | | | |
|---|---|---|---|
| 3,257,208 | 6/1966 | Van Paesschen et al. | 96/114 |
| 3,625,694 | 12/1971 | Cohen et al. | 96/114 |
| 3,811,897 | 5/1974 | Babbit et al. | 96/114 |
| 3,926,869 | 12/1975 | Horie et al. | 96/114 |
| 3,938,999 | 2/1976 | Yoneyama et al. | 96/114 |

*Primary Examiner*—Richard L. Schilling
*Attorney, Agent, or Firm*—Arthur H. Rosenstein

[57] ABSTRACT

A photographic element comprising a support, a layer containing certain photographically useful and/or active fragments and a layer containing a dye mordant composition comprising a polymer having recurring units of the formula selected from the group consisting of:

wherein:

$R^2$ is hydrogen or alkyl;
$R^1$ is hydrogen, alkyl or aryl;
L is a linking group;
W is an electron-withdrawing group;
X is a leaving group; and
n is 0 or 1.

The polymeric mordants covalently bond with dyes or dye precursors and are especially useful in diffusion transfer processes.

7 Claims, No Drawings

PHOTOGRAPHIC FILM UNITS CONTAINING A POLYMERIC MORDANT WHICH COVALENTLY BONDS WITH CERTAIN DYES

This is a division of application Ser. No. 906,289, filed May 15, 1978 which is a continuation-in-part of U.S. Ser. No. 839,879 filed Oct. 6, 1977 now abandoned.

The presens invention relates to novel photographic elements containing polymeric compounds as dye mordants.

It is known in the photographic art to use various polymeric materials and mordants in color image-transfer elements comprising a support and layer generally containing a silver halide emulsion to prevent the migration of dyes or other photographically useful and/or active fragments. Receiving elements containing mordants are described, for example, in U.S. Pat. Nos. 2,584,080 and 3,770,439.

Many of the polymeric mordants described in the prior art are quite useful in preventing migration of the dyes from the mordanted layer. Polymeric mordants useful in this respect include those described in U.S. Pat. Nos. 3,958,995, 3,526,694 and the like. While nonionic, anionic and cationic polymers have been found to be satisfactory mordants for use in image-transfer units, it would be desirable to provide mordants which can better receive and hold dyes from migration.

It is an object of this invention to provide photographic elements containing polymeric mordants which have particularly strong holding properties with respect to certain dyes.

It is a further object of this invention to provide a photographic element comprising a support, photographically useful and/or active fragments, a silver halide layer and at least one layer comprising a polymeric mordant composition.

Still another object of this invention is to provide an integral image-transfer unit comprising a support, at least one photosensitive silver halide emulsion layer having associated therewith certain dye image-providing materials, and an image-receiving layer comprising a polymeric mortant capable of covalently bonding with the dye.

These objects are accomplished by incorporating in the element, particular photographically useful and/or active fragments and particularly dye or dye precursors, and polymeric mordants which contain reactive groups which will covalently bond to the photographically useful and/or active fragments.

The photographically useful or active fragment (PUF) useful herein can be any nucleophilic fragment which is released in a photographic element preferably in an imagewise fashion. For example, the photographically useful group can be a photographic dye or dye precursor, or a photographic reagent such as a development inhibitor, a development accelerator, a bleach inhibitor, a bleach accelerator, a coupler (e.g. a competing coupler, a color-forming coupler, a development inhibitor releasing coupler, etc.), a developing agent (e.g., a competing developing agent), a silver halide solvent, a silver complexing agent, a fixing agent, a toner, a hardener, a fogging agent, an antifoggant, a chemical or spectral sensitizer, a desensitizer, etc.

The photographically useful group can be present in the photographic element as a preformed species or it can be present in a blocked form or as a precursor.

The PUF materials of this invention can include a moiety which is an image-dye former. The term "image-dye former" is understood to refer to those compounds which undergo reactions encountered in a photographic imaging system to produce an image dye, such as color couplers, oxichromic compounds and the like.

The PUF materials described herein have particular application in a diffusion transfer process where it is desired to have a dye entity transferred to an adjacent layer or a receiving element. However, in certain embodiments, this invention relates to the release of an imagewise distribution of a diffusible photographically useful compound which is a photographic reagent. Typical useful photographic reagents are known in the art, such as in U.S. Pat. Nos. 3,227,551, 3,698,898, 3,379,529 and 3,364,022, for example a silver complexing agent, a silver halide solvent, a fixing agent, a toner, a hardener, an antifoggant, a fogging agent, a sensitizer, a desensitizer, a developer or an oxidizing agent.

The photographically useful fragment can be a silver halide development inhibitor including triazoles and tetrazoles such as a 5-mercapto-1-phenyltetrazole, a 5-methylbenzotriazole, a 4,5-dichlorobenzotriazole and the like, and it can also be an antifoggant including azaindenes such as a tetrazaindene and the like. The compounds which contain releasable silver halide development inhibitors or antifoggants can generally be used in the photographic elements in association with silver halide layers wherein said compound can be incorporated in amounts such as 0.01 to 1 g/m$^2$ dissolved in a coupler solvent such as diethyl lauramide. When these compounds are incorporated in photographic elements in association with negative silver halide emulsions, a positive imagewise distribution of inhibitor or antifoggant will be produced upon development if released from a positive-working carrier. Thus, silver development is inhibited or restrained in the low-exposure toe but not in the shoulder as seen on the sensitometric curve. Development inhibition of the unexposed areas is thereby achieved selectively. When the silver halide emulsions also have dye releasers in accordance with this invention associated therewith, the overall effect of the inhibitor or antifoggant is to release more dye in the unexposed regions, improving maximum image dye density to the image-receiving layer without increasing the amount of dye released in the exposed regions.

The photographically useful fragment can also be a silver halide development accelerator such as nucleophilic substituted benzyl alcohol, benzylpicolinium bromide, foggants including hydrazines and hydrazides such as an N-acetyl-N'-phenylhydrazine and the like, or auxiliary developers such as hydroquinones, a 1-phenyl-3-pyrazolidone, an ascorbic acid and the like. When these compounds are used in photographic elements in association with negative silver halide emulsions which also have associated therewith positive-working image dye-providing materials in accordance with this invention, the released dye density of all dyes in the unexposed regions would be somewhat reduced by fog development. If, however, one layer was unexposed while the other two were given an imagewise exposure, the amount of foggant or development accelerator reaching the unexposed layer from the other two layers would be less where those layers were exposed. Hence, the Dmax of the unexposed layer would increase as a function of exposure of the other two layers. This greatly enhances the saturation of single colors in a photograph.

When color couplers are present in the compounds of this invention, the coupler can be released in areas where no development occurs and can diffuse to an adjacent layer where they can be reacted with an oxidized color developer such as a primary aromatic amine to form the image dye. Generally, the color coupler and the color developer are so chosen that the reaction product is immobile. Typical useful color couplers include the pyrazolone couplers, pyrazolotriazole couplers, open-chain ketomethylene couplers, phenolic couplers and the like. Further reference to the description of appropriate couplers is found in Marchant, U.S. Pat. No. 3,620,747 issued Nov. 16, 1971, which is incorporated herein by reference.

The fragments containing oxichlormic moieties can also be advantageously used in a photographic system since they are generally colorless materials due to the absence of an image-dye chromophore. Thus, they can also be used directly in the photographic emulsion or on the side of the film unit through which exposure takes place without competitive absorption. Compounds of this type are those compounds which undergo chromogenic oxidation to form the respective image dyes. The oxidation can be carried out by aerial oxidation, incorporation of oxidants into the photographic element or film unit, or use of an oxidant during processing. Compounds of this type have been referred to in the art as leuco compounds, i.e., compounds which have no color. Typical useful oxichromic compounds include leuco indoanilines, leuco indophenols, leuco anthraquinones and the like. In certain preferred embodiments, the compounds of this invention contain oxichromic moieties as described in Lestina and Bush, U.S. Pat. No. 3,880,658, which is incorporated herein by reference.

The particular PUF materials including dyes, dye precursors or dyes released from dye-providing compounds useful in this invention are those having appended thereto a moiety selected from the group consisting of aminoalkyl preferably having the formula ZNHR, sulfonamido preferably having the formula

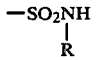

and phenolic preferably having the formula

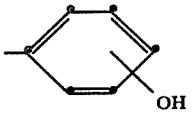

wherein R is H or alkyl, preferably containing from about 1 to about 6 carbon atoms such as ethyl, methyl, isopropyl, chlorobutyl and the like. Z is an alkylene or cycloalkylene group preferably containing from 1 to 6 carbon atoms such as methylene, ethylene, cyclohexylene, and the like or arylenealkylene such as phenylenemethylene and Z and R can be taken together with the NH to complete an N containing heterocyclic group preferably containing from 5 to 7 carbon atoms. Dyes, dye precursors and dyes released from dye-providing materials containing these groups are preferred and are well known to those skilled in the art.

Examples of dyes or dye precursors containing the ZNHR groups are amine dyes such as

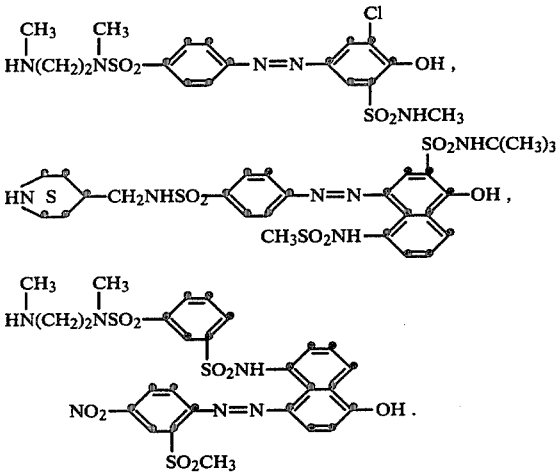

Examples of those dyes or dye precursors containing —$SO_2NHR$ groups are sulfonamido dyes such as:

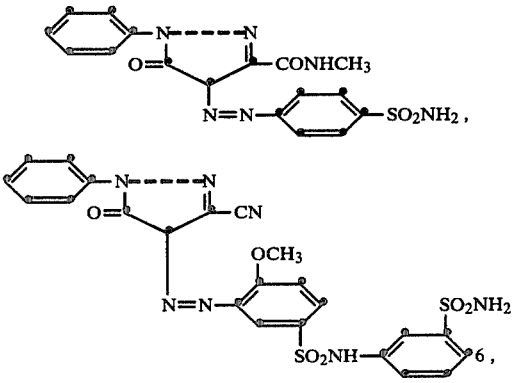

-continued

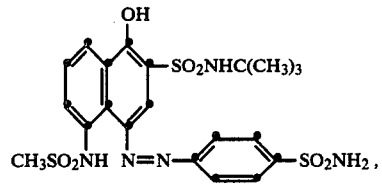

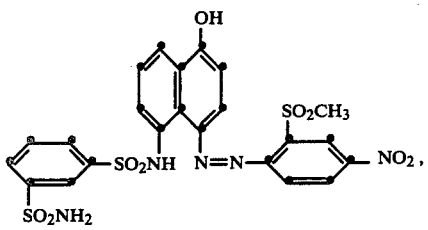

and the like.

Examples of those dyes or dye precursors containing:

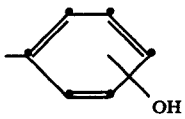

groups are phenol dyes such as:

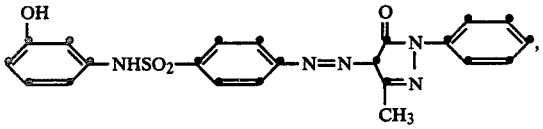

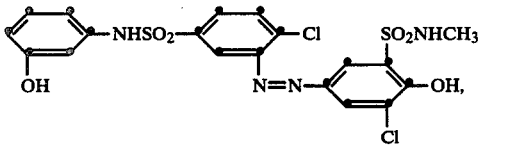

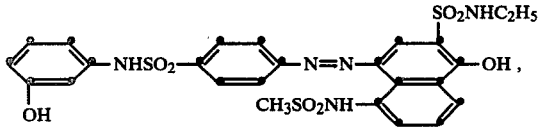

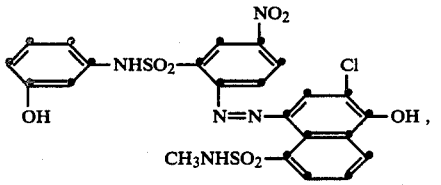

and the like.

In general, image dye precursors are those materials which contain the chromophore of the desired image dye in a latent state, including, for example colorless compounds such as leuco dyes that are converted to image dyes by oxidation, and shifted dyes which are initially colored but whose maximum absorption can be shifted to the desired image hue by chemical means such as hydrolysis, pH change, etc.

Any of the dyes or dye precursors can be released from dye-providing compounds such as those described in Fleckenstein U.S. Pat. No. 4,076,529 which is incorporated herein by reference.

The polymeric mordants useful in this invention to bond covalently with the classes of PUFs described above are nonionic, anionic or cationic homopolymers or copolymers containing recurring units having the formula selected from the group consisting of:

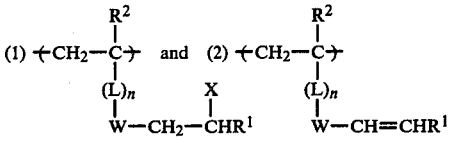

wherein $R^2$ is hydrogen or alkyl; n=0 or 1; $R^1$ is hydrogen, alkyl or aryl; L is a bivalent linking group providing a linkage between the vinyl group and W; W is an electron-withdrawing group and X is a leaving group which can be displaced by a nucleophile or eliminated in the form of HX by treatment with alkali; said PUF material and said recurring units forming a covalent bond on contact.

When $R^2$ is alkyl, it preferably contains from 1 to 6 carbon atoms such as methyl, ethyl and the like.

$R^1$ can be hydrogen, alkyl preferably containing from 1 to 12 carbon atoms as described above for $R^2$, or aryl preferably containing from 6 to 13 carbon atoms such as phenyl, naphthyl, tolyl, xylyl and the like.

It is understood that, wherever alkyl, aryl or alkylene is described in the specification, the terms are meant to include isomers thereof and substituted alkyl, aryl or alkylene wherein the substituent does not adversely affect the covalent bonding of the dye to the polymer.

The linking group L can be selected from the group consisting of alkylene, preferably containing from about 1 to about 6 carbon atoms such as methylene, isopropylene, hexylene and the like; arylene preferably containing from about 6 to about 10 carbon atoms such as phenylene, naphthalene and the like; arylenealkylene preferably containing from about 7 to about 11 carbon atoms such as benzyl; $COOR^3$; and $CONHR^3$ wherein $R^3$ is selected from the group consisting of arylene, alkylene or arylenealkylene such as described above.

X is a leaving group which can be displaced by elimination in the form of HX under alkaline conditions such as hydroxy, chloro, bromo, iodo, alkyl and arylsulfonyloxy ($—OSO_2R'$), ammonio, sulfato ($—OSO_3—$), and the like.

The electron withdrawing group W stabilizes an α-carbanion which facilitates the elimination of HX resulting in an electron deficient double bond. W can be selected from the group consisting of $—SO_2—$, —CO—, —SO—,

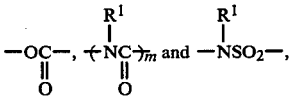

wherein m is 1 or 2 and $R^1$ is as described above.

When n=0 in formulas 1) or 2) then W is $—SO_2—$ or

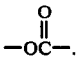

A highly preferred class of polymers according to the structure described above has repeating units having the formulae:

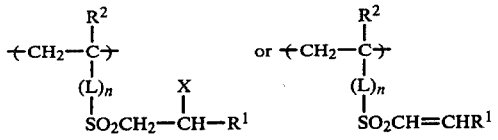

wherein $R^1$, $R^2$, L, n and X are as described above. Examples of these polymers are poly(vinylbenzyl 2-chloroethyl sulfone), poly(vinylbenzyl vinyl sulfone) and the like. The monomers can be prepared by reacting a vinylaryl hydroxyalkyl sulfone with thionyl chloride in a solvent in the presence of pyridine. The polymer can be formed by conventional means. An example of the preparation of polymers of this type is shown in preparations 8 and 9 hereinafter. Further description of the preparation of these polymers can be found in U.S. Pat. No. 4,161,407 issued July 17, 1979, by Campbell entitled "Crosslinkable Polymers Having Vinylsulfonyl Groups or Styrylsulfonyl Groups and Their Use as Hardeners for Gelatin."

Another preferred class of polymers are those containing repeating units having the formulas:

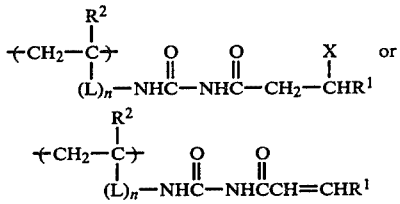

wherein $R^1$, $R^2$, L, n and X are as described above. Examples of these polymers are poly[N-(2-methacryloyloxyethyl)-N'-(3-chloropropionyl)urea] and poly[N-(2-methacryloyloxyethyl)-N'-(acryloyl)urea], and the like. Monomers which can be polymerized or copolymerized to form repeating units such as these can be prepared by reacting a chloroalkylisocyanate with an aminoalkyl acrylamide hydrochloride in the presence of a pyridine in a solvent and the polymers can be prepared by free radical polymerization of the corresponding chloroethylmonomer followed by dehydrohalogenation of the resulting polymer. An example of the formation of these polymers is presented herein after as preparation 2.

Another preferred class of polymers are those containing recurring units having the formulae:

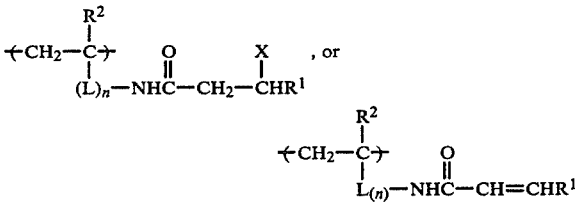

wherein $R^1$, $R^2$, L, X, and n are as described above.

Monomers which can be polymerized or copolymerized to form repeating units such as these can be prepared by reacting chloroalkyl chloride with an aminoalkyl methacrylate hydrochloride in solvent in the presence of pyridine. The polymer can be prepared by any known means. An example of the formation of a polymer of this type is presented hereinafter as preparation 3.

A monomer of the type which can be polymerized as above to form units when W of the formulae on page 10 is SO or $SO_2$ is shown in preparation 4; a monomer of the type which can be polymerized as above to form units wherein W of the formulae on page 10 is $NR^1SO_2$ is shown in preparation 5. A monomer which can be polymerized as above to form units wherein W of the formulae on page 10 is —OCO— is shown in preparation 6; and a monomer which can be polymerized as above to form units wherein W of the formulae on page 10 is —CO— is shown in preparation 7.

The polymers containing the recurring units described above preferably comprise anionic, cationic or nonionic polymers comprised of the above units and units derived from copolymerizable ethylenically unsaturated monomers. Although the preferred copolymerizable monomers form units which act as mordants for dyes in themselves, basically any polymerizable monomer may be used to form the polymeric mordant.

Cationic polymers can be formed by copolymerizing monomers forming the units described above in formulas (1) and (2) and monomers which form repeating units such as:

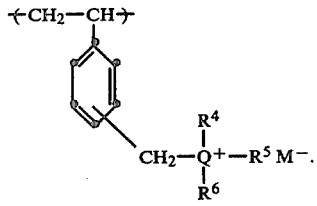

wherein Q is N or P, $R^4$ to $R^6$ are independently carbocyclic or alkyl groups, and $M^-$ is an anion such as described in U.S. Pat. No. 3,958,995, and other cationic units such as N-(methacryloyloxyethyl)-N,N,N-trimethylammonium methosulfate, N-(methacryloaminopropyl)-N,N,N-trimethylammonium chloride, and the like.

Anionic polymers can be formed by copolymerizing with the monomers forming the units described in formulas (1) and (2), monomers which form repeating units such as sodium-2-sulfoethyl methacrylate, sodium 2-acrylamido-2-methylpropanesulfonate, sodium vinylbenzylsulfonate, sodium vinylbenzenesulfonate, and the like.

Nonionic polymers can be formed by copolymerizing with the units of formulas (1) and (2), monomers which form repeating units such as acrylamide, N-vinylpyrrolidinone, N-isopropylacrylamide, and the like.

The polymers can be either homopolymers having the repeating units of formulas (1) and (2) or copolymers of these with other cationic, anionic or nonionic ethylenically unsaturated monomers. Preferred cationic copolymers are poly[m and p-vinylbenzyltrimethylammonium chloride-co-m and p-vinylbenzyl 2-chloroethyl sulfone] (1:1 w) and poly[m and p-vinylbenzyltrimethylammonium chloride-co-m and p-vinylbenzyl vinyl sulfone-co-divinylbenzene] (49:49:2 w). A preferred anionic copolymer is poly[m and p-vinylbenzyl 2-chloroethyl sulfone-co-sodium 2-sulfoethyl methacrylate] (1:1 w).

A preferred nonionic copolymer is poly[acrylamide-co-vinylbenzyl 2-chloroethyl sulfone] (80:20 w). Preferably, the copolymers comprise from about 10 to about 90 weight percent of the repeating units of formulas (1) and (2).

The homopolymers or copolymers can be formed by free radical polymerization of the corresponding monomers and by optionally treating the resulting polymers with alkali.

It has been found that certain of the polymers are more likely to form covalent bonds with certain dyes, thus forming especially strong bonds with said dyes in the image-receiving layer. Thus, the polymers containing recurring units having the formulae:

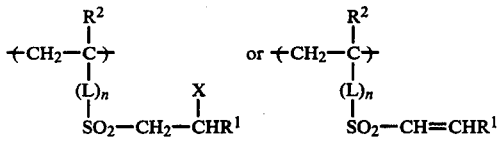

covalently bond with the PUF materials containing as substituents (having appended thereto) ZNHR groups when the polymer is anionic, and provides covalent bonds with PUF materials having appended thereto ZNHR, $-SO_2NHR$ or:

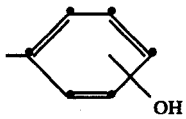

when the polymer is cationic or nonionic.

It has also been found that polymers containing the recurring units have the formulae:

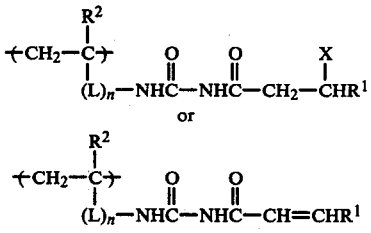

covalently bond with PUF materials having appended thereto ZNHR when the polymer is cationic or nonionic, and will covalently bond with dye or dye precursors having appended thereto ZNHR, $-SO_2NHR$ or:

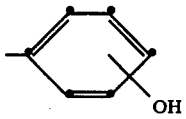

when the polymer is cationic.

Polymers containing the recurring units having the formula:

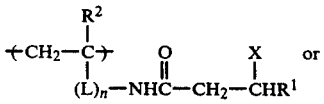

-continued

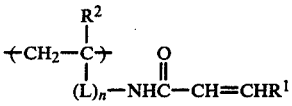

provide covalent bonds with PUF materials having appended thereto ZNHR when the polymer is cationic.

A simple test may be used to determine if the polymer and dye or dye-providing material form a covalent bond on contact. The test comprises:

(a) preparing a dye-receiving element by coating a poly(ethylene terephthalate) film support with a layer comprising gelatin at 2.16 g/m$^2$, a divinylsulfonyl ether hardener at 0.04 g/m$^2$, and the polymeric mordant at 5.5 millimoles/m$^2$ of reactive unit of formulas (1) or (2);

(b) immersing separate samples of receiving element in 1.0 percent by weight aqueous solution of the dye for up to 10 minutes, washing in water for 20 minutes and air-drying; and (c) measuring the dye density at maximum absorption and determining the percentage of covalent bonding from the dye density lost after subsequent treatment of each sample for 2 minutes in a solvent mixture consisting of 200 ml of methanol, 200 ml of $CH_2Cl_2$, 20 ml of water and 10 g $NH_4SCN$, which solvent removes substantially all dye not covalently bonded. The percentage of dye or dye precursor covalently bonded to the polymer should be at least 5% and preferably 50 to 100%.

The dye mordant composition is quite useful in the preparation of photographic elements comprising a support and at least one layer comprising a dye mordant and at least one layer comprising a dye or dye precursor. The support can comprise any photographic support material such as paper, baryta-coated paper, resin-coated paper, pigment-coated polymeric film, poly(ethylene terephthalate), cellulose acetate, glass, grained aluminum, polycarbonates and the like such as described in *Product Licensing Index,* Vol. 92, Dec., 1971, publication 9232, pp. 107–110. The support can consist of any of the above materials or like materials coated with various layers such as timing layers, overcoat layers, acid layers and the like. The support is coated with a substantially aqueous dispersion of the polymer according to the invention, and thereafter the layer or layers containing the dyes or dye precursors are applied.

In a highly preferred embodiment, this invention relates to image-transfer film units comprising:

(a) a photosensitive element comprising a support having thereon at least one layer containing a silver halide emulsion having associated therewith an image dye-providing material containing or which releases a moiety containing the ZNHR, $-SO_2NHR$ or

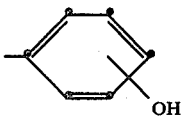

moieties;

(b) an image-receiving layer containing the above-described mordants; and (c) means containing an alkaline processing composition adapted to discharge its contents within said film unit.

Mordanting amounts of the polymers according to this invention can be employed as such from a substantially aqueous medium or can be incorporated in water-permeable hydrophilic organic colloid binders and the resulting mixture used in the preparation of dye imbibition printing blanks, receiving layers for color-transfer processes such as those described by U.S. Pat. Nos. 3,362,819 by Land, 2,983,606 by Rogers, 3,227,552 by Whitmore and 3,227,550, and in antihalation layers such as those described by Jones et al, U.S. Pat. No. 3,282,699. Satisfactory colloids which can be used for this purpose include any of the hydrophilic colloids generally employed in the photographic field including, for example gelatin, colloidal albumin, polysaccharides, cellulose derivatives, synthetic resins such as polyvinyl compounds, including polyvinyl alcohol derivatives, acrylamide polymrs and the like. In general, a mordanting amount can be employed in a dye-mordanting or dye image-receiving layer. The amount of dye mordant to be used depends on the amount of dye to be mordanted, the mordanting polymers, the imaging chemistry involved, etc. The amount can be determined easily by one skilled in the art. The dye image-receiving element can comprise a support having the polymeric mordant of this invention thereon. The element may also comprise other layers such as a polymeric acid layer and can also include a timing layer as taught in U.S. Pat. No. 2,584,030 and disclosed in U.S. Pat. No. 3,362,819 or a light-reflective interlayer comprising a light-reflective white pigment such as $TiO_2$ and the polymeric binder in accordance with the teaching of Beavers and Bush, U.S. Pat. No. 3,445,228.

The mordanting polymers according to this invention are also especially useful in light-filtering layers such as in antihalation layers of the type disclosed by Jones and Milton, U.S. Pat. No. 3,282,699. Here, the light-filtering layer preferably can comprise a hydrophilic colloid and the polymer of this invention. The layer is adapted to contain a dye held or fixed by the mordant.

In certain preferred embodiments, the mordants of this invention are employed in image-transfer film units to mordant the image dye. The mordants can generally be used in any image-transfer film unit format where initially mobile compounds are used, such as dye developers, or where initially immobile compounds are used, such as compounds which release a diffusible dye as a function of oxidation of the compound. Typical useful image-transfer formats are disclosed in U.S. Pat. Nos. 2,432,181, 2,983,606, 3,227,550, 3,227,552, 3,415,645, 3,415,644, 3,415,646 and 3,635,707, Canadian Patent No. 674,082 and Belgian Patent Nos. 757,959 and 757,960, both issued Apr. 23, 1971. In highly preferred embodiments, the mordants of this invention are used in the photographic element of an image-transfer film unit which is designed to be processed with a single processing solution, and the resulting positive image is viewed through a transparent support and against an opaque background.

In highly preferred embodiments, the mordants of this invention are useful in color image-transfer film units which comprise:

(a) a photosensitive element comprising a support having thereon at least one layer containing a silver halide emulsion having associated therewith an image dye-providing material and preferably three of said layers which contain, respectively, a blue-sensitive silver halide emulsion, a green-sensitive silver halide emulsion and a red-sensitive silver halide emulsion;

(b) an image-receiving layer containing the mordants of the above formula which can be located on a separate support and superposed on said support containing said silver halide emulsion layers or, preferably, it can be coated on the same support adjacent the photosensitive silver halide emulsion layers; and (c) means containing an alkaline processing composition adapted to discharge its contents within said film unit. Where the receiver layer is coated on the same support with the photosensitive silver haide layers, the support is preferably a transparent support, a reflecting layer and opaque layer are preferably positioned between the image-receiving layer and the photosensitive silver halide layer, and the alkaline processing composition preferably contains an opacifying substance such as carbon or a combination of a pH-indicator dye and a pigment such as $TiO_2$ which is discharged into the film unit between a dimensionally stable support or cover sheet and the photosensitive element.

In certain embodiments, the cover sheet can be superposed or adapted to be superposed on the photosensitive element. The mordant layer can be located on the cover sheet. In certain preferred embodiments where the image-receiving layer is located in the photosensitive element, a neutralizing layer is located on the cover sheet.

A means for containing the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosensitive element, hypodermic syringes, and the like.

The term "image dye-providing material" as used herein is understood to refer to those compounds which either do not require a chemical reaction to form the image dye or undergo reactions encountered in photographic imaging systems to produce an image dye, such as with color couplers, oxichromic compounds (leuco dyes), pre-formed dyes including indicator dyes, shifted dyes, and the like.

The terms "initially diffusible" and "initially immobile" as used herein refer to compounds which are incorporated in the photographic element and, upon contact with an alkaline processing solution, are substantially diffusible or substantially immobile, respectively.

The image dye-providing materials, in one embodiment where negative silver halide emulsions are used, can be initially mobile image dye-providing materials such as those used in image-transfer photographic elements. Typical useful, initially mobile image dye-providing materials include dye developers as disclosed in U.S. Pat. Nos. 2,983,606, 3,255,001 and the like; oxichromic developers which undergo chromogenic oxidation to form image dyes as disclosed in U.S. Pat. No. 3,880,658; shifted indophenol dye developers as disclosed by Bush and Reardon, U.S. Pat. No. 3,854,985; metallized dye developers as disclosed in U.S. Pat. Nos. 3,482,972, 3,544,545, 3,511,406 and 3,563,739; and the like, all of which are incorporated herein by reference.

The image dye-providing material in another preferred embodiment, especially when negative silver halide emulsions are used, is an initially immobile image dye-providing material. Preferably, the initially immobile image dye-providing material is a positive-working immobile photographic compound such as disclosed by Hinshaw and Condit, British Patent No. 1,464,104 and U.S. Pat. No. 3,980,479 which are incorporated herein by reference.

Other especially preferred image dye-providing materials for use with negative emulsions to produce positive dye images are the quinonyl carbonates, quinonylmethyl carbonates, and α-nitro-arylcarboxamides described in Chasman, Dunlap and Hinshaw, U.S. Pat. No. 4,139,379 issued Feb. 13, 1979 and Hinshaw and Henzel U.S. Pat. No. 4,139,389 issued Feb. 13, 1979.

In another embodiment, immobile image dye-providing compounds can be used in association with silver halide emulsions wherein said compounds undergo oxidation followed by hydrolysis to provide an imagewise distribution of a mobile image dye. Compounds of this type can be used with negative emulsions to form positive image records in the exposed photographic element, or they can be used with direct-positive or reversal emulsions to form positive transfer images such as in an image-transfer film unit. Typical useful compounds of this type are disclosed in Canadian Patent No. 602,607 by Whitmore et al issued Aug. 2, 1960, U.S. Pat. No. 4,076,529 by Fleckenstein et al, U.S. Pat. Nos. 3,698,897 by Gompf et al, 3,928,312 by Fleckenstein, 3,728,113 by Becker et al, 3,725,062 by Anderson et al, 3,227,552 by Whitmore, 3,443,939, 3,443,940 and 3,443,941 and the like, all of which are incorporated herein by reference.

In highly preferred embodiments, the mordants of the above formula are used in image-transfer film units which also contain an immobile image dye-providing material which releases a sulfonamido dye as a function of oxidation. Typical useful materials which release sulfonamido dyes as a function of oxidation followed by hydrolysis are disclosed by Fleckenstein et al, U.S. Pat. No. 4,076,529, and Fleckenstein, U.S. Pat. No. 3,928,312, which are incorporated herein by reference.

In still other embodiments, the above mordants can be used in image-transfer film units containing a layer comprising a negative silver halide emulsion and having an adjacent layer containing physical development nuclei associated with an image dye-providing material. Typical photographic elements of this type are disclosed in U.S. Pat. No. 3,227,551 (col. 6-7) and British Patent No. 904,364 (p. 19), which are incorporated herein by reference.

The dye image-providing material need only have appended thereto a moiety selected from the group consisting of ZNHR, $—SO_2NHR$ and:

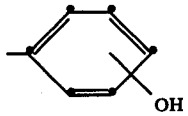

where R and Z are as described above. The sulfonamidophenol dye releasers described by Fleckenstein et al in Published U.S. Pat. No. 4,076,529 can be prepared containing the moieties described above by the methods described in U.S. Pat. No. 4,076,529.

The mordants can also be used for fixing the dyes used in the preparation of photographic filter, antihalation and gelatino-silver-halide emulsion layers. Such layers can be coated on conventional photographic supports, such as flexible sheet supports (e.g. cellulose acetate, polyester films, polyvinyl resins, etc.) or paper, glass, etc.

More than one of the mordanting polymers of this invention can be used together, in a single layer or in two or more layers. The mordanting polymers of this invention can also be used in admixture with other mordants in the same layer or in separate layers of the same element.

It is noted herein that the term "in reactive association with" is intended to mean that the materials can be in either the same or different layers so long as the materials can perform reactive functions with each other.

In an image-transfer unit containing the dye or dye precursors and the polymeric mordants of this invention, a color image can be transferred to an image-receiving layer by using a film unit comprising a transparent support coated with the image-receiving layer containing the polymeric mordants, an opaque light-reflective layer, a black opaque layer and photosensitive layers having associated therewith dye image-providing materials containing the groups capable of forming covalent bonds with the polymer mordants. A rupturable container containing an alkaline processing composition and an opacifier such as carbon black is positioned adjacent the top layer and a transparent cover sheet. The cover sheet can comprise a transparent support which is coated with a neutralizing layer and a timing layer. The film unit is placed in a camera, exposed through the transparent cover sheet, and then passed through a pair of pressure-applying members in the camera as it is being removed therefrom. The pressure-applying members rupture the container and spread processing composition and opacifier over the image-forming portion of the film unit. The silver halide layers are developed and dye images are formed as a function of development. The dyes diffuse to the image-receiving layer to provide an image which is viewed through the transparent support on the opaque reflecting layer background. The timing layers break down after a period of time and make available materials to neutralize the alkaline processing composition and to shut down further silver halide development.

Various other processes can also be used to produce images using the units of this invention. For instance, transparencies can be made by retaining the element containing the photosensitive layers after exposure and processing. The dyes in the non-image areas would be transferred to the mordant and the unit could be peeled apart to reveal the retained dye image in the photosensitive element. Reflective prints can also be prepared in somewhat the same manner.

The following examples further illustrate the invention.

Preparation 1—Poly(vinylbenzyltrimethylammonium chloride-co-vinylbenzyl 2-chloroethyl sulfone) (1:1 w)

A solution of 30 g of mαp-vinylbenzyltrimethylammonium chloride, 30 g of mαp-vinylbenzyl 2-chloroethyl sulfone and 300 mg of 2,2'-azobis(2-methylpropionitrile) in 240 ml of dimethyl sulfoxide was flushed with nitrogen and heated at 60° C. overnight. The polymer was isolated by precipitation in acetone, collected by filtration, washed with acetone and dried in vacuo at room temperature.

Yield = 58.4 g.

Anal. Found: C, 57.5; H, 7.0; Cl, 13.7; S 5.0; N, 3.1. $[\eta]_{0.1\ N\ NaCl} = 0.24$.

Preparation 2

Part A - Preparation of N-(3-Methylacrylamidopropyl)N'-(3-chloropropionyl)urea

Pyridine (7.9 g, 0.1 mole) was added dropwise to a mixture of β-chloropropionylisocyanate (13.3 g, 0.1 mole) and N-(3-aminopropyl)methacrylamide hydrochloride (17.8 g, 0.1 mole) in N,N-dimethylformamide (80 ml) at 0° C. The mixture was left to stir overnight at ambient temperature. This mixture was then poured onto ice, and the product filtered. Recrystallization from absolute ethanol (400 ml) gave 1-(3-chloropropionyl)-3-methacrylamidopropyl urea, mp 131°-2° C.

Yield = 70 percent.

Anal. Calcd. for $C_{11}H_{18}ClN_3O_3$: C, 47.9; H, 6.6; Cl, 12.9; N, 15.2. Found: C, 47.1; H, 6.7; Cl, 13.0; N, 20.6.

Mass Spectrum m/e (M+, 275).

Part B - Poly[acrylamide-co-N-(3-methacrylamidopropyl)-N'-(3-chloropropionyl)urea] (8:2 w)

A solution of 36 g of acrylamide, 9 g of N-(3-methacrylamidopropyl)-N'-(3-chloropropionyl)urea, and 225 mg of 2,2'-azobis(2-methylpropionitrile) in 405 ml of dimethylsulfoxide was flushed with nitrogen for ½ hour and heated at 60° C. overnight to yield a viscous polymer solution. The polymer was isolated by precipitation from acetone, and it was collected by filtration and dried in vacuo at room temperature to give 45 g.

$[\eta]_{0.1\ NNaCl} = 1.35$.

Preparation 3

Part A - Preparation of N-(2-(Methacryloyloxyethyl)-3-chloropropionamide

Pyridine (15.8 g, 0.2 mole) was added dropwise to a mixture of 3-chloropropionyl chloride (12.7 g, 0.1 mole) and 2-aminoethyl methacrylate hydrochloride (16.5 g, 0.1 mole) in N,N-dimethylformamide (20 ml) at 0° C. The mixture was left to stir overnight at ambient temperature. The solvent was evaporated in vacuo, and the residue was dissolved in dichloromethane (500 ml). The mixture was then washed with saturated sodium chloride (24,200 ml), dried over anhydrous magnesium sulfate, and the solvent removed. The product was collected by distillation, bp 104°-110° C. at 2μ.

Yield = 55 percent.

Anal. Calcd. for $C_9H_{14}ClNO_3$: C, 49.2; H, 6.4; Cl, 16.1; N, 6.4. Found: C, 49.1; H, 6.8; Cl, 16.4; N, 6.8.

Part B - Poly[vinylbenzyltrimethylammonium chlorideco-N-(2-methacryloyloxyethyl)-3-chloropropionamide] (1:1 w)

A solution of 5 g of vinylbenzyltrimethyl ammonium chloride, 5 g of N-(2-methacryloyloxyethyl)-3-chloropropionamide, and 50 mg of 2,2'-azobis(2-methylpropionitrile) in 50 ml of dimethyl sulfoxide was flushed with nitrogen for ½ hour and then heated at 60° C. overnight. The resultant polymer was isolated in acetone, collected by filtration, and dried in vacuo at room temperature to yield 9.4 g.

Anal. Found: C, 54.4; H, 7.8; Cl, 13.4; N, 6.0.

$[\eta]_{0.1NNaCl} = 0.81$.

Preparation 4—Preparation of 2-Chloroethylsulfinylmethylstyrene

Vinylbenzyl 2-hydroxyethyl sulfide is oxidized with a 6.5 percent molar excess of sodium meta-periodate ($NaIO_4$) in a 1:1 (volume) mixture of water and methanol at 0° C. over a 3-hour period to 2-hydroxyethylsulfinylmethylstyrene. The precipitated sodium iodate ($NaIO_3$) is removed by filtration and the filtrate extracted with methylene chloride. The extracts are dried over $MgSO_4$ and the solvent removed to provide the crude intermediate, which is crystallized from 1:1, hexane:ethyl acetate.

The intermediate is converted to the 2-chloroethylsulfinylmethylstyrene by treatment with thionyl chloride in tetrahydrofuran.

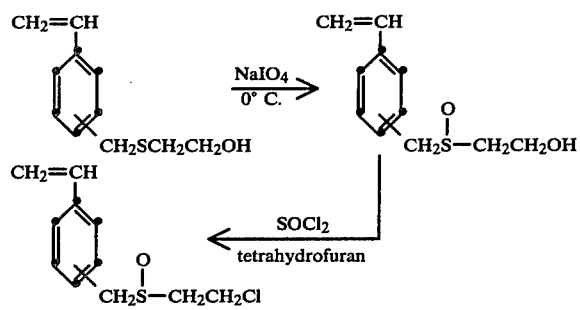

Preparation 5—Preparation of 2-(2-Chloroethylsulfonylamino)-ethyl methacrylate

2-Aminoethyl methacrylate hydrochloride is condensed with 2-chloroethanesulfonyl chloride to produce the 2-(2-chloroethylsulfonylamino)ethyl methacrylate.

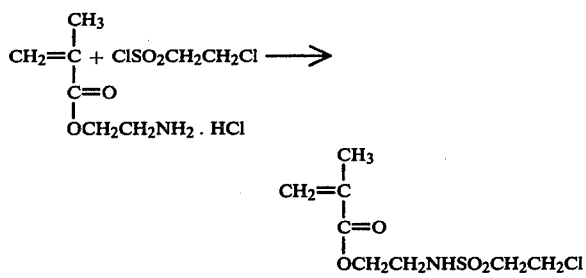

Preparation 6—Preparation of Vinylbenzyl 3-chloropropionate

Vinylbenzyl alcohol is condensed with 3-chloropropionyl chloride by conventional esterification procedures to produce the vinylbenzyl 3-chloropropionate.

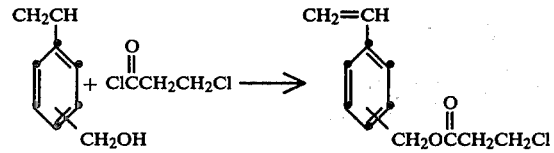

Preparation 7—Preparation of 6-Acrylamido-6-methyl-3-oxoheptyl chloride

The title compound is prepared by the Ritter reaction of acrylonitrile with 7-chloro-2-methyl-5-oxo-1-heptene in the presence of sulfuric acid.

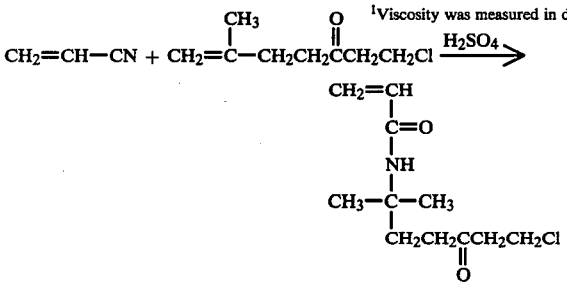

Preparation 8—Monomer of Vinylbenzyl 2-chloroethylsulfone

To a solution of 50 g (0.221 moles) of vinylbenzyl 2-hydroxyethyl sulfone, 19.2 g (0.243 moles) of pyridine, and 1 g of m-dinitrobenzene in 500 ml of tetrahydrofuran at 0° to 5° C. was added dropwise 28.9 g (0.243 moles) of thionyl chloride. After the addition was complete, the mixture was refluxed for 2 hours, cooled to 0° to 5° C., and the pyridine hydrochloride was removed by filtration. The solvent was then evaporated to leave an oil which was added to 1 l of ice water to crystallize the product. The solid was collected by filtration and recrystallized from 1.6 l of 50 percent water, 50 percent ethanol to give 46 g (85.2 percent) of the desired product (mp 62° to 84° C.).

Preparation 9—Poly(vinylbenzyl 2-chloroethyl sulfone)

A solution of 35 g of vinylbenzyl 2-chloroethyl sulfone as in Preparation 3 and 175 g of 2,2'-azobis(2-methylpropionitrile) in 70 ml of dimethyl sulfoxide was heated at 60° C. under a nitrogen atmosphere for 25 hours. The polymer was precipitated in methanol, collected by filtration, and dried in vacuo at room temperature to give 32.5 g (93 percent) of polymer.

$\{\eta\}$ DMF=0.65.

Anal. Calcd. for $C_{11}H_{13}ClO_2S$: C, 54.0; H, 5.3; Cl, 14.5; S, 13.1. Found: C, 54.1; H, 5.6; Cl, 13.9; S, 13.1.

All inherent viscosities reported herein are determined at 25° C. at 0.25 g/deciliter of solution.

Copolymers derived from vinylbenzyl-2-chloroethyl sulfone are given in Table I.

Table 1

Copolymers Derived from Vinylbenzyl 2-Chloroethyl Sulfone

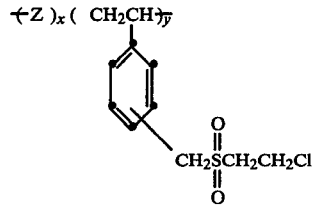

| Monomer from which Z is Derived | x | y | Polymerization Method | [η][1] | Anal. Calcd/Found C | H | Cl | S | N |
|---|---|---|---|---|---|---|---|---|---|
| 2-Acrylamido-2-methylpropane sulfonic acid | 2 | 1 | solution | 0.33 | 45.8 | 5.9 | 5.6 | 14.6 | 4.1 |
| | | | | | 45.4 | 5.4 | 8.2 | 13.9 | 2.3 |
| Acrylamide | 9 | 1 | solution | — | 51.6 | 6.6 | 4.0 | 3.6 | 14.2 |
| | | | | | 49.0 | 6.6 | 3.0 | 3.2 | 13.5 |
| Vinylbenzyl chloride | 1 | 1 | emulsion | 0.65 | 60.5 | 5.5 | 17.9 | 8.1 | — |
| | | | | | 59.4 | 5.3 | 17.4 | 7.9 | — |
| Styrene | 1 | 1 | emulsion | 1.33 | 65.4 | 6.1 | 10.2 | 9.4 | — |
| | | | | | 64.1 | 5.9 | 9.9 | 9.4 | — |
| Maleic anhydride | 1 | 1 | solution (benzene) | 0.45 | 52.6 | 4.4 | 10.3 | 9.4 | — |
| | | | | | 53.3 | 4.5 | 10.2 | 9.1 | — |

[1]Viscosity was measured in dimethylformide (DMF).

EXAMPLE 1

The cationic polymer of preparation 1 having the structure:

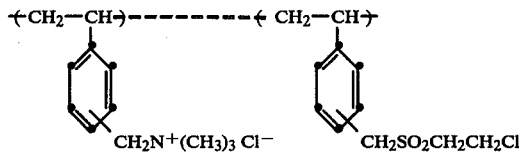

was used in a mordant layer and its mordanting properties to a dye according to the invention was compared with that of a similar conventional cationic polymeric mordant having the structure:

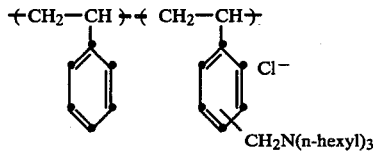

as described in U.S. Pat. No. 3,898,088 to the same dye.

A dye image-receiving element (Element A) was prepared comprising a transparent poly(ethylene terephthalate) film support having coated thereon (1) a layer containing the polymer of Preparation 1 at 200 mg/ft$^2$ (2.16 g/m$^2$) and gelatin at 200 mg/ft$^2$ (2.16 g/m$^2$), (2) a layer containing gelatin at 50 mg/ft$^2$ (0.54 g/m$^2$) and a bis(vinylsulfonylmethyl) ether hardener, and (3) a reflecting layer containing titanium dioxide at 200 mg/ft$^2$ (2.16 g/m$^2$) and gelatin at 200 mg/ft$^2$ (2.16 g/m$^2$).

A second receiving element (Element B) was prepared as above, except that the polymer of preparation 1 was replaced with an equivalent amount of the prior art control mordant described above.

The mordants were then evaluated by transferring a dye from a photographic element comprising a negative-working silver halide emulsion and a redox dye-releasing compound having the structure:

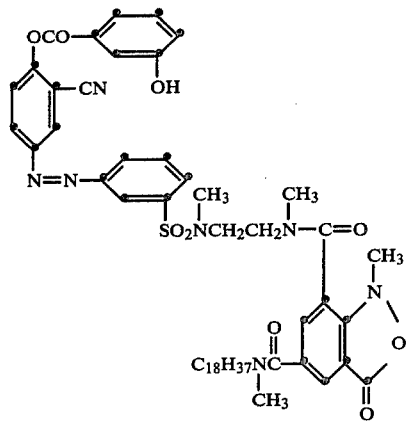

by rupturing a pod containing 56 g/l potassium hydroxide, 23 g/l potassium bromide and 25 g/l hydroxyethyl cellulose between samples of the photographic element and either Element A or Element B. Because of redox dye-releasing compound is designed to release a diffusible yellow dye under alkaline conditions in the absence of an oxidized, crossoxidizing developing agent, a uniform distribution of yellow dye was transferred to the receiving element. The elements were separated after 5 minutes and the receiving elements were washed for about 5 minutes.

The receiving elements which contain the yellow dye (hereinafter denoted as the senders) were then brought in contact with additional samples of either Elements A or B which did not contain dye (hereinafter denoted as the receivers) while rupturing a pod between the two mordant-containing elements which contained a viscous buffering solution comprising 23 g/l potassium bromide and 23 g/l hydroxyethyl cellulose dissolved in 1 liter of a pH 5 phosphate buffer. The elements were left laminated and the mordant competition was evaluated by the amount of dye transferred from the sender to the receiver 12 hours after lamination, as measured by the reflection density to blue light from both sides of the laminated structure. Table 1 below records the mordant competition values, measured as the ratio of reflection density between combinations of Elements A and B acting as the sender and receiver.

Table 1

| Sender/Receiver | | Competition |
|---|---|---|
| Element | Mordant | Ratio* |
| A/B | Preparation 1/prior art | 2.18 |
| B/A | prior art/Preparation 1 | $(2.43)^{-1}$ |
| A/A | Preparation 1/Preparation 1 | 23.5 |

*reflection density to blue light as measured inthe sender divided by the reflection density asmeasured in the receiver after 12 hours lamination It is apparent from the above results that, when the yellow dye was transferred at pH 14 to a mordant receiver containing the mordant of the instant application, quantitative covalent bonding was obtained as demonstrated by the failure of consecutive relaminations at pH 5 with the prior art and preparation 1 receivers to remove the dye from the sender. On the other hand, the Preparation 1 receiver removes the dye nearly quantitatively from the prior art receiver at pH 5.

Further evidence of covalent bonding was obtained when the dye could not be removed from the Preparation 1 containing element with a 2% solution of thiocyanate ion in $CH_3OH/CH_2Cl_2$ (50:50 by volume), a treatment which rapidly removed the dye from the prior art mordant-containing element.

It was further found that the polymeric mordant of the instant invention was stable even after being subjected to severe keeping conditions.

EXAMPLE 2

This is a comparative example.

Cationic mordants containing reactive sites are reacted with the list of Technicolor dyes described as being useful with polymeric mordants in U.S. Pat. No. 3,625,694 to determine if they covalently bonded with said dyes, as follows:

Dye-receiving elements were prepared by coating a poly(ethylene terephthalate) film support with a layer comprising gelatin at 200 mg/ft$^2$ (2.16 g/m$^2$), a bis(-vinylsulfonylethyl) ether hardener at 4.0 mg/ft$^2$ (0.04 g/m$^2$) and a mordant (see Table 2) at 0.51 mmoles of reactive site/ft$^2$ (5.5 mmoles/m$^2$).

Separate samples of each receiving element were them immersed in 1.0% aqueous solution of the dyes listed in Table 2 for 1–10 minutes, washed for 20 minutes and airdried.

The dye density at maximum absorption (λmax) was then measured and the percent of covalent bonding was estimated from the dye density lost after subsequent treatment of each sample for 2 minutes in an organic solvent mixture consisting of 200 ml methanol, 200 ml $CHCl_2$, 20 ml $H_2O$ and 10 g $NH_4SCN$. This organic solvent mixture was formulated to remove substantially all dye which was not covalently bonded. After treatment with solvent, the samples were washed in water for 20 minutes and air-dried.

The results are tabulated in Table 2.

Table 2

| Dye[a] | Mordant | Density | λmax | % Covalent Bonding[b] |
|---|---|---|---|---|
| Fast Red S Conc. 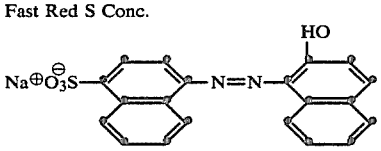 | Control (2.16 g./m.$^2$) | 1.49 | 525 | 0 |
| | A (2.34 g./m.$^2$) | 1.41 | 525 | 0 |
| | B (2.56 g./m.$^2$) | 1.70 | 525 | 0 |
| | C (2.31 g./m.$^2$) | 1.40 | 525 | 0 |

Table 2-continued

| Dye[a] | Mordant | Density | λmax | % Covalent Bonding[b] |
|---|---|---|---|---|
| Pontacyl Green NV | Control | 1.03 | 645 | 0 |
| 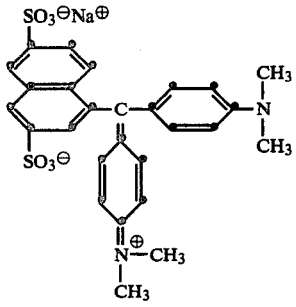 | A | 0.68 | 645 | 0 |
| | B | 0.83 | 645 | 0 |
| | C | 0.70 | 645 | 0 |
| Acid Blue Black | Control | 1.51 | 635 | 0 |
| 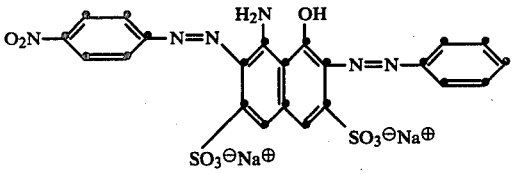 | A | 1.26 | 630 | 0 |
| | B | 1.34 | 635 | 0 |
| | C | 1.20 | 630 | 0 |
| Acid Magenta O | Control | With all four mordants, this dye | | |
| 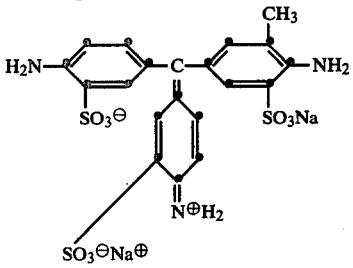 | A | washed off in the initial water | | |
| | B | wash. Therefore, no covalent bond- | | |
| | C | ing was evident. | | |
| Naphthol Green B Conc. | Control | 0.35 | 690 | 0 |
| 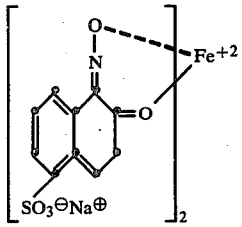 | A | 0.52 | 690 | 0 |
| | B | 0.34 | 690 | 0 |
| | C | 0.40 | 690 | 0 |
| Brilliant Paper Yellow | Control | 0.30 | 420 | 0 |
| 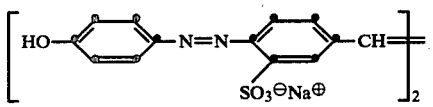 | A | 0.28 | 420 | 0 |
| | B | 0.38 | 420 | 0 |
| | C | 0.30 | 420 | 0 |
| Tartrazine | Control | 1.13 | 440 | 0 |
| 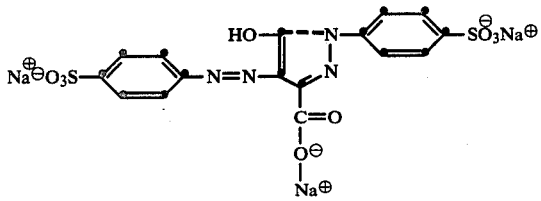 | A | 0.70 | 430 | 0 |
| | B | 0.35 | 430 | 0 |
| | C | 0.60 | 430 | 0 |
| Methanil Yellow | Control | 0.30 | 430 | 0 |
| 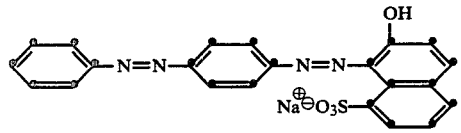 | A | 0.14 | 430 | 0 |
| | B | 0.25 | 430 | 0 |
| | C | 0.29 | 430 | 0 |
| Pontacyl Carmine 6B | Control | 1.62 | 525<br>560 | 0 |

Table 2-continued

| Dye[a] | Mordant | Density | λmax | % Covalent Bonding[b] |
|---|---|---|---|---|
| 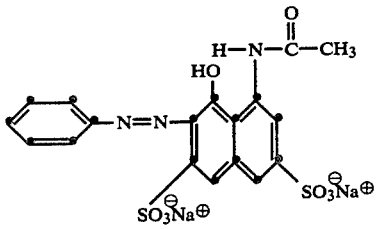 | A | 1.29 | 525<br>560 | 0 |
| | B | 1.40 | 525<br>560 | 0 |
| | C | 1.50 | 525<br>560 | 0 |
| Pontacyl Scarlet R | Control | 0.50 | 515 | 0 |
| 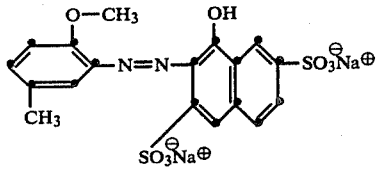 | A | 0.82 | 515 | 0 |
| | B | 0.60 | 515 | 0 |
| | C | 0.70 | 515 | 0 |
| Pontacyl Rubine R | Control | 2.57 | 535 | 0 |
| 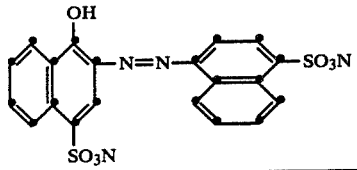 | A | 1.42 | 525 | 0 |
| | B | 1.91 | 530 | 0 |
| | C | 1.60 | 530 | 0 |

[a]Except for Acid Magenta O, Acid Blue Black and Pontacyl Green NV, each dye was dissolved in 1.0 N sodium hydroxide to give a 1.0% solution. The above three dyes are alkali-unstable and were dissolved in distilled water to give a 1.0% solution.

[b]Removal of substantially all dye from the samples of receivers during treatment in the organic solvent mixture indicated that no covalent bonding had occurred with dyes outside the scope of the present invention.

[c]Control Mordant

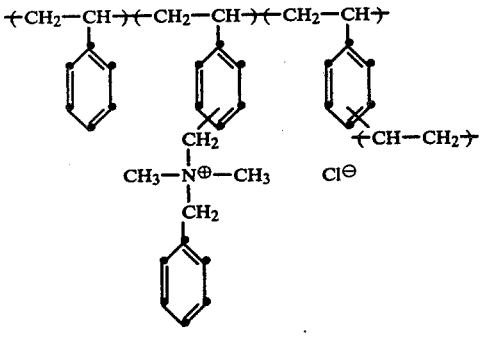

[d]Mordant A

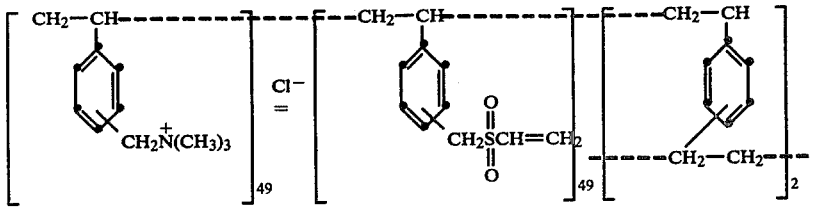

[e]Mordant B

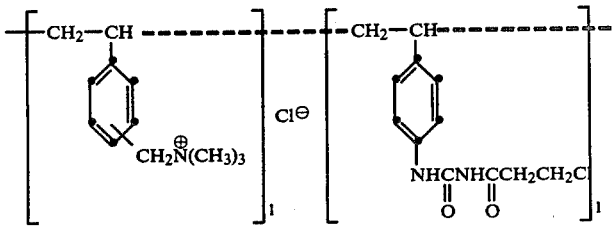

[f]Mordant C

Table 2-continued

| Dye[a] | Mordant | Density | λmax | % Covalent Bonding[b] |
|---|---|---|---|---|
| 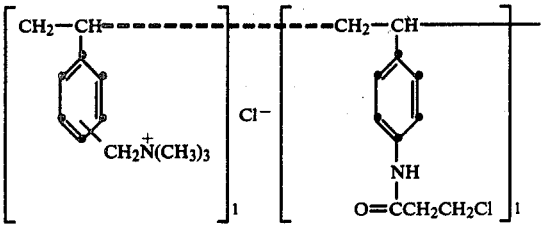 | | | | |

EXAMPLE 3

Evaluation of the covalent mordanting of amine dyes

The covalent mordanting of amine dyes with mordants within the scope of the present invention was evaluated accordng to the following procedure:

Dye-receiving elements were prepared by coating a poly(ethylene terephthalate) film support with a layer containing gelatin at 200 mg/ft$^2$ (2.16 g/m$^2$), a bis(vinylsulfonylmethyl)ether hardener at 4.0 mg/ft$^2$ (0.04 g/m$^2$) and a mordant (see Table 3) coated at 0.51 mmoles of reactive site/ft$^2$ (weight quantities in Table 2).

Dried samples of each receiving element were laminated to samples of a multicolor image-transfer element with a viscous alkaline activator comprising 1.2 N potassium hydroxide solution (no developer) spread between. After 10 minutes, the elements were separated and the receiver samples were water-washed for 20 minutes and dried.

The multicolor image-transfer element employed is represented by the following schematic structure (coverages in mg/ft$^2$; g/m$^2$):

gelatin (91; 0.98)
blue-sensitive silver halide (100 Ag; 1.08 Ag);
gelatin (300; 3.24); yellow-dye releaser (58;
0.63); electron donor:

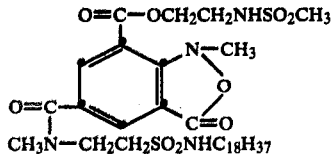

-continued (73; 0.78); diethyl lauramide (131; 1.4)
gelatin (180; 1.94); interlayer scavenger; filter dye
green-sensitive silver halide (100 Ag; 1.08 Ag);
gelatin (300; 3.24); magenta-dye releaser (67;
0.72); electron donor:

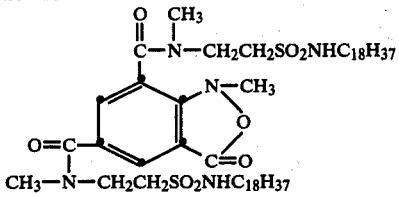

(1.47; 1.59); 2,4-di-n-amylphenol (214; 2.31)
gelatin (120; 1.30); interlayer scavenger
red-sensitive silver halide (100 Ag; 1.08 Ag);
gelatin (300; 3.24);cyan-dye releaser (41;
0.44); electron donor:

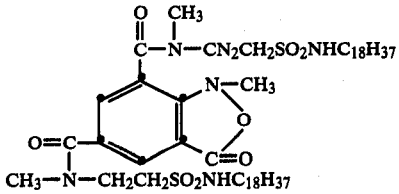

1.02); 2,4-di-n-amylphenol (135; 1.46)
/ / / poly(ethylene terephthalate) support/ / / /

The coated samples and results are recorded in Table 3.

Table 3

| Receiver | Mordant[f] No. | Mordant[f] mg./ft.$^2$ | Mordant Reactive Site | Mordant Charge | Transmission Density[b] and Percent of Covalent Bonding (CB)[a]: Yellow Dye[c] $D_{Blue}$ | Yellow Dye[c] % CB | Magenta Dye[d] $D_{Green}$ | Magenta Dye[d] % CB | Cyan Dye[e] $D_{Red}$ | Cyan Dye[e] % CB |
|---|---|---|---|---|---|---|---|---|---|---|
| A (control) | Control 1 | 161 | none | cationic | 1.20 | 0 | 1.10 | 0 | 0.87 | 0 |
| B (control) | Control 2 | 200 | none | cationic | 1.10 | 0 | 1.00 | 0 | 0.90 | 0 |
| 1 | D | 233 | vinylsulfone | cationic | 1.26 | 92 | 1.20 | 85 | 1.10 | 30 |
| 2 | A | 217 | vinylsulfone | cationic | 1.09 | 79 | 1.05 | 62 | 0.74 | 28 |
| 3 | E | 152 | vinylsulfone | cationic | 0.87 | 76 | 1.07 | 54 | 0.85 | 10 |
| 4 | F | 220 | vinylsulfone | nonionic | 1.02 | 84 | 1.13 | 44 | 0.72 | 27 |
| 5 | G | 620 | vinylsulfone | nonionic | 1.27 | 98 | 1.20 | 97 | 0.86 | 97 |
| 6 | H | 177 | vinylsulfone | anionic | 0.90 | 100 | 0.80 | 91 | 0.59 | 87 |
| 7 | I | 313 | vinylsulfone | anionic | 0.98 | 100 | 0.93 | 98 | 0.62 | 97 |
| 8 | B | 237 | carbamyl-acrylamide | cationic | 1.16 | 99 | 0.83 | 91 | 0.79 | 99 |
| 9 | J | 233 | carbamyl-acrylamide | cationic | 1.25 | 96 | 0.62 | 95 | 0.92 | 96 |
| 10 | K | 273 | carbamyl-acrylamide | cationic | 1.24 | 95 | 1.11 | 83 | 0.90 | 83 |
| 11 | L | 638 | carbamyl-acrylamide | nonionic | 0.30 | 96 | 0.25 | 80 | 0.48 | 98 |

Table 3-continued

| | | | | | | | | | | |
|---|---|---|---|---|---|---|---|---|---|---|
| 12 | M | 233 | carbamyl-acrylamide | anionic | 0.94 | 97 | 0.00 | 0 | 0.48 | 90 |
| 13 | N | 250 | carbamyl-acrylamide | anionic | 0.84 | 100 | 0.00 | 0 | 0.25 | 100 |
| 14 | C | 214 | acrylamide | cationic | 1.20 | 80 | 1.19 | 73 | 0.93 | 34 |
| 15 | O | 224 | acrylamide | cationic | 1.24 | 83 | 1.10 | 75 | 0.95 | 37 |
| 16 | P | 112 | acrylamide | anionic | 0.00 | 0 | 0.00 | 0 | 0.00 | 0 |

Table 3 footnotes:

[a]The percent of covalent bonding was estimated from the dye density loss after treatment of the dyed receiver for 2 minutes with an organic solvent mixture comprising 200 ml MeOH, 200 ml $CH_2Cl_2$, 20 ml $H_2O$ and 10 g $NH_4SCN$.

[b]A transmission density of 0.9 is approximately equal to a reflection density of 2.0.

[c]Yellow amine dye

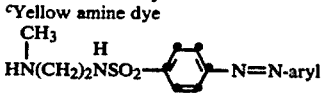

released from yellow dye releaser:

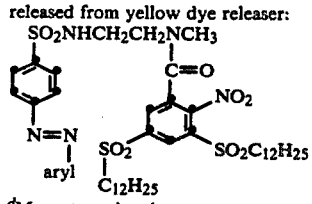

[d]Magenta amine dye

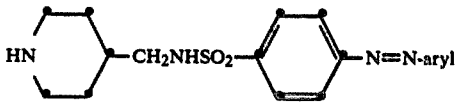

released from magenta dye releaser:

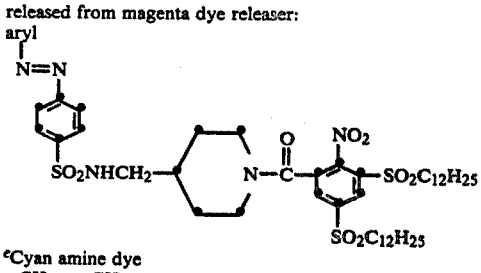

[e]Cyan amine dye

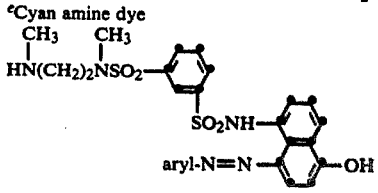

released from cyan dye releaser:

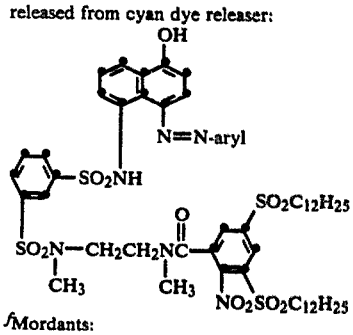

[f]Mordants:

Control 1:

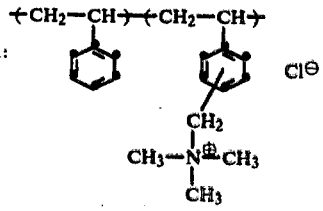

Table 3-continued
Control 2:
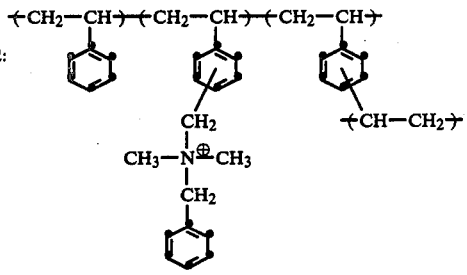
A:
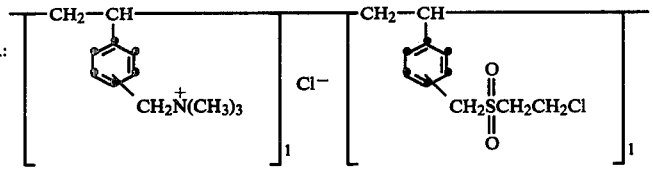
B:
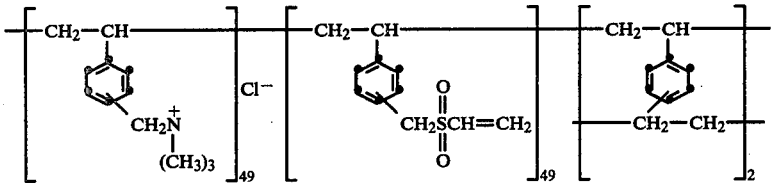
C:
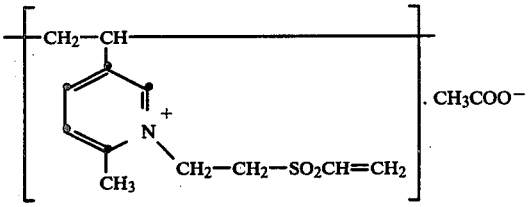
D:
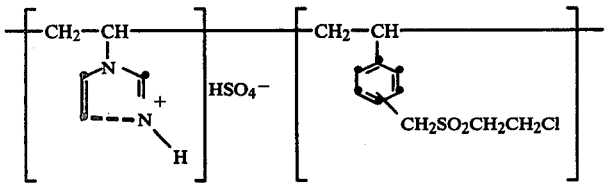
E:
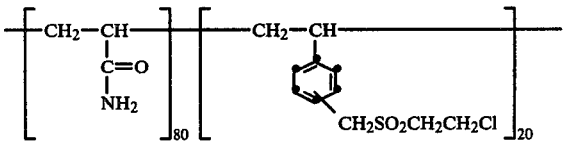
F:
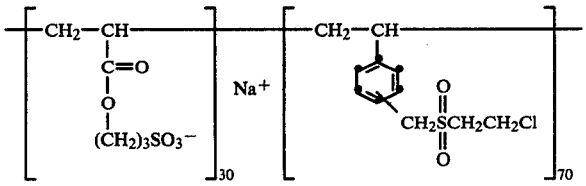
G:
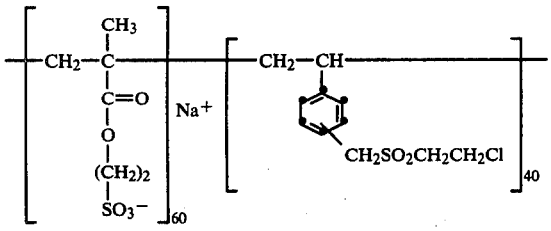

Table 3-continued
H:
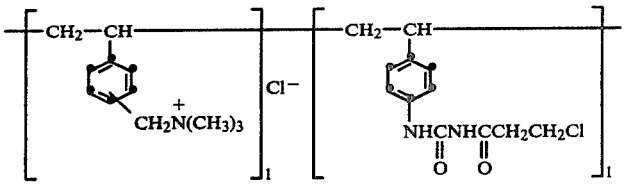
I:
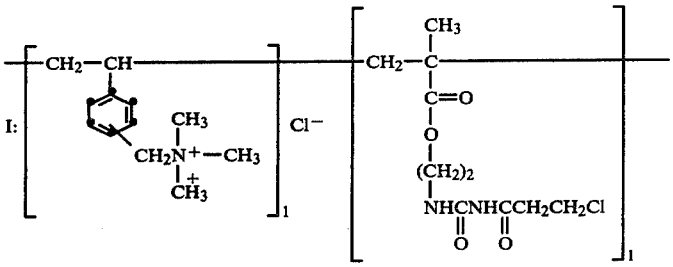
J:
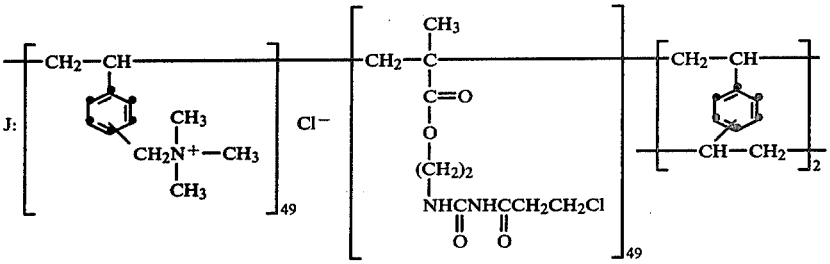
K:
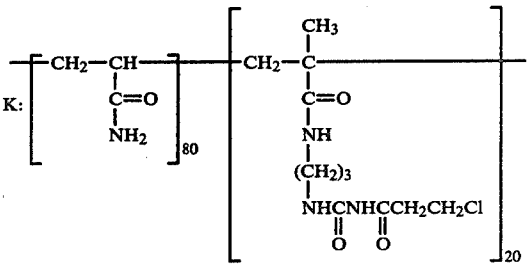
L:
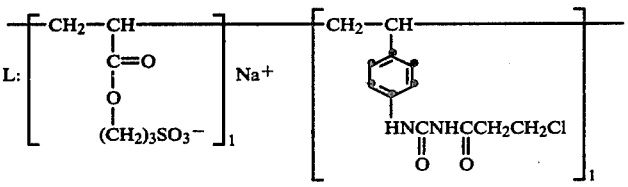
M:
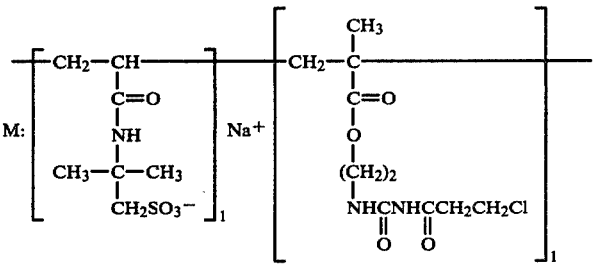
N:
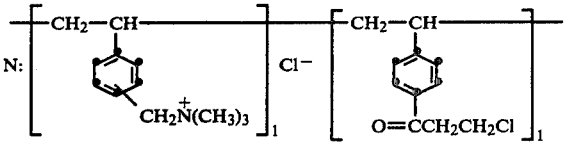

Table 3-continued

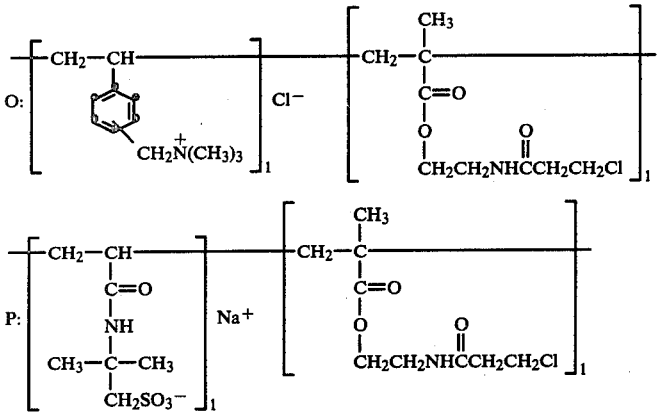

EXAMPLE 4

Evaluation of the covalent mordanting of sulfonamide dyes

Samples of the receiver elements described in Example 3 were laminated to samples of fogged (developable) photosensitive elements comprising a poly(ethylene terephalate) support having coated thereon a layer containing a negative-working silver bromide emulsion at 0.3 g. Ag/m$^2$, gelatin at 3.3 g/m$^2$ and either the cyan-dye releaser I at 0.3 mmoles/m$^2$, magenta-dye releaser II at 0.3 mmoles/m$^2$, yellow-dye releaser III at 0.6 mmoles/m$^2$ or yellow-dye releaser IV at 0.6 mmoles/m$^2$.

A pod containing a portion of a viscous processing composition comprising 48 g KOH, 7.2 g of 4-hydroxymethyl-4-methyl-1-phenyl-3-pyrazolidone and 40 g of carboxymethyl cellulose per liter of water was spread between the laminated structure to provide a 0.056 mm-thick developer layer. After 5 minutes, the elements were separated and the dyed receivers were washed in water for 20 minutes and air dried.

The percentage of covalent bonding was then estimated by treatment in an organic solvent mixture as described in Example 3.

The results are recorded in Table 4.

Table 4

| | Mordant | | Mordant Reactive | Mordant | Transmission Density and Percent of Covalent Bonding (CB) | | | | | | | |
|---|---|---|---|---|---|---|---|---|---|---|---|---|
| | | | | | Yellow Dye I[a] | | Yellow Dye II[b] | | Magenta Dye[c] | | Cyan Dye[d] | |
| Receiver | Number | mg/ft$^2$ | Site | Charge | $D_{blue}$ | % CB | $D_{blue}$ | % CB | $D_{green}$ | % CB | $D_{red}$ | % CB |
| A (control) | Control 1 | 161 | none | cationic | 0.54 | 0 | 0.98 | 0 | 1.05 | 0 | 1.60 | 0 |
| B (control) | Control 2 | 200 | none | cationic | 0.49 | 0 | 0.89 | 0 | 1.16 | 0 | 1.69 | 0 |
| 1 | D | 233 | vinylsulfone | cationic | 0.58 | 83 | 1.00 | 33 | 1.10 | 44 | 1.80 | 31 |
| 2 | A | 217 | vinylsulfone | cationic | 0.56 | 86 | 0.92 | 36 | 1.84 | 57 | 1.59 | 43 |
| 3 | E | 152 | vinylsulfone | cationic | 0.40 | 50 | 0.88 | 10 | 1.61 | 9 | 1.58 | 8 |
| 4 | F | 220 | vinylsulfone | nonionic | 0.33 | 20 | 0.84 | 16 | 1.32 | 14 | 1.34 | 18 |
| 5 | G | 620 | vinylsulfone | nonionic | 0.93 | 84 | 0.17 | 71 | 0.37 | 30 | 0.85 | 41 |
| 6 | H | 177 | vinylsulfone | anionic | .00 | 0 | .00 | 0 | .00 | 0 | .00 | 0 |
| 7 | I | 313 | vinylsulfone | anionic | .00 | 0 | .00 | 0 | .00 | 0 | .00 | 0 |
| 8 | B | 237 | carbamyl-acrylamide | cationic | 0.46 | 67 | 0.97 | 40 | 1.00 | 37 | 1.87 | 49 |
| 9 | J | 233 | carbamyl-acrylamide | cationic | 0.40 | 32 | 1.05 | 18 | 0.75 | 27 | 1.74 | 30 |
| 10 | K | 273 | carbamyl-acrylamide | cationic | 0.48 | 10 | 0.96 | 24 | 1.05 | 19 | 1.69 | 27 |
| 11 | L | 638 | carbamyl-acrylamide | nonionic | .00 | 0 | .00 | 0 | .00 | 0 | .00 | 0 |
| 12 | M | 233 | carbamyl-acrylamide | anionic | .00 | 0 | .00 | 0 | .00 | 0 | .00 | 0 |
| 13 | N | 250 | carbamyl-acrylamide | anionic | .00 | 0 | .00 | 0 | .00 | 0 | .00 | 0 |
| 14 | C | 214 | acrylamide | cationic | 0.48 | 0 | 0.98 | 0 | 1.58 | 0 | 1.58 | 0 |
| 15 | O | 224 | acrylamide | cationic | 0.41 | 0 | 0.77 | 0 | 1.41 | 0 | 0.86 | 0 |
| 16 | P | 112 | acrylamide | anionic | .00 | 0 | .00 | 0 | .00 | 0 | .00 | 0 |

Sulfonamide dyes:

[a] yellow dye

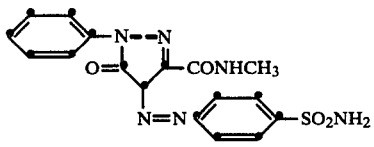

Table 4-continued
| | | | | | Transmission Density and Percent of Covalent Bonding (CB) | | | | | | | |
|---|---|---|---|---|---|---|---|---|---|---|---|---|
| | Mordant | | Mordant Reactive | Mordant | Yellow Dye I[a] | | Yellow Dye II[b] | | Magenta Dye[c] | | Cyan Dye[d] | |
| Receiver | Number | mg/ft² | Site | Charge | $D_{blue}$ | % CB | $D_{blue}$ | % CB | $D_{green}$ | % CB | $D_{red}$ | % CB |
released from IV:
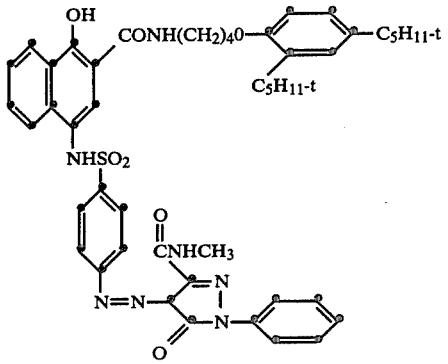
[b]yellow dye
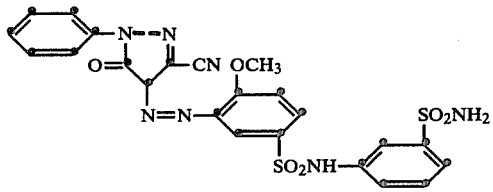
released from III:
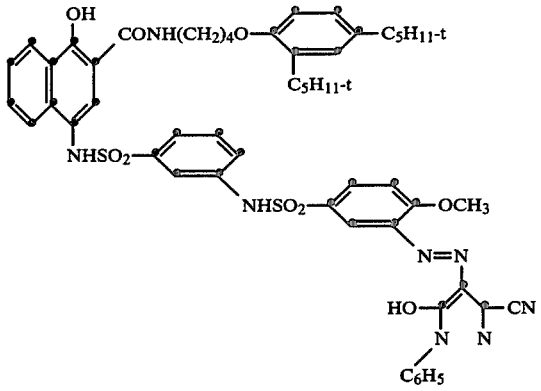
[c]magenta dye
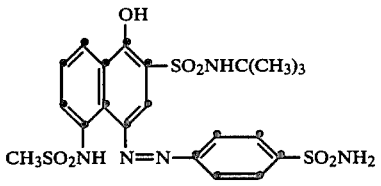
released from II:

Table 4-continued

| Receiver | Mordant Number | Mordant mg/ft² | Mordant Reactive Site | Mordant Charge | Transmission Density and Percent of Covalent Bonding (CB): Yellow Dye I[a] $D_{blue}$ | Yellow Dye I[a] % CB | Yellow Dye II[b] $D_{blue}$ | Yellow Dye II[b] % CB | Magenta Dye[c] $D_{green}$ | Magenta Dye[c] % CB | Cyan Dye[d] $D_{red}$ | Cyan Dye[d] % CB |
|---|---|---|---|---|---|---|---|---|---|---|---|---|
| 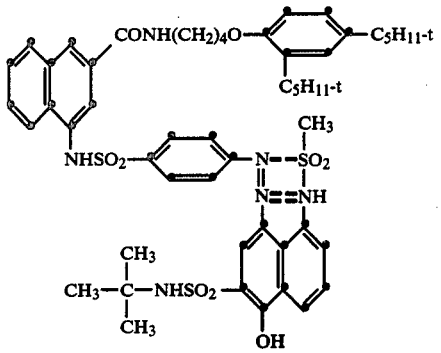 | | | | | | | | | | | | |
| [d]cyan dye | | | | | | | | | | | | |
| 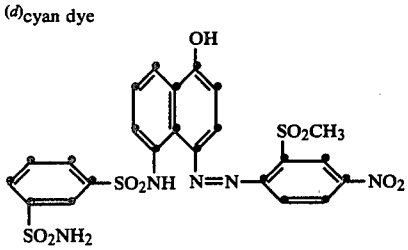 | | | | | | | | | | | | |
| released from I: | | | | | | | | | | | | |
| 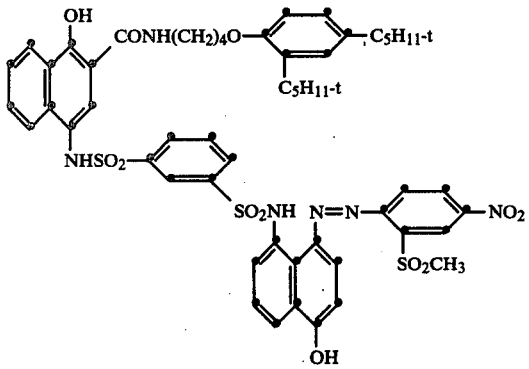 | | | | | | | | | | | | |

EXAMPLE 5

Evaluation of covalent mordanting of phenol dyes

Samples of the receiver elements described in Example 3 were laminated to samples of single-layer, photosensitive image-transfer elements containing quinone dye releasers of the type described by Chasman et al, U.S. Pat. No. 4,139,379 issued Feb. 13, 1979. Each element consisted of a poly(ethylene terephthalate) film support having coated thereon a layer containing a negative-working silver halide emulsion at 100 mg Ag/ft² (1.08 g/m²), gelatin at 200 mg/ft² (2.16 g/m²), a ballasted electron-accepting nucleophilic displacement (BEND) compound as the dye-providing substance, and an electron donor. The BEND compound and electron donor were dissolved in an equal weight of diethyl lauramide and dispersed in gelatin prior to coating.

| Coating No. | Dye-Providing Elements: BEND Compound No. | BEND Compound moles/ft² | Electron Donor No. | Electron Donor moles/ft² |
|---|---|---|---|---|
| 1 | 1 | $5 \times 10^{-5}$ | 1 | $1.0 \times 10^{-4}$ |
| 2 | 2 | $3.5 \times 10^{-5}$ | 2 | $7.0 \times 10^{-5}$ |

The phenol dyes released from the quinone BEND compounds were transferred to the receiver elements by employing the procedure described in Example 3.

The percentage of covalent bonding was then estimated by treatment in an organic solvent mixture as described in Example 3.

The results are recorded in Table 5.

Table 5

| Receiver | Mordant No. | Mordant mg./ft.$^2$ | Mordant Reactive Site | Mordant Charge | Transmission Density and Covalent Bonding (CB): Yellow Dye I[a] $D_{Blue}$ | Yellow Dye I[a] % CB | Cyan Dye[b] $D_{Red}$ | Cyan Dye[b] % CB |
|---|---|---|---|---|---|---|---|---|
| A (control) | Control 1 | 161 | none | cationic | 0.70 | 0 | 1.10 | 0 |
| B (control) | Control 2 | 200 | none | cationic | 0.61 | 0 | 1.08 | 0 |
| 1 | D | 233 | vinylsulfone | cationic | 0.70 | 8 | 1.27 | 25 |
| 2 | A | 217 | vinylsulfone | cationic | 0.75 | 5 | 1.34 | 28 |
| 3 | G | 620 | vinylsulfone | nonionic | 0.00 | 0 | 0.41 | 93 |
| 4 | B | 237 | carbamyl-acrylamide | cationic | 0.60 | 62 | 1.41 | 45 |
| 5 | C | 214 | acrylamide | cationic | 0.76 | 0 | 1.07 | 8 |
| 6 | P | 112 | acrylamide | anionic | .00 | 0 | .00 | 0 |

Phenol dyes:

[a]yellow dye

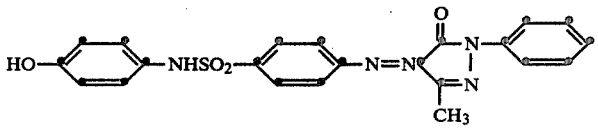

released from BEND Compound 1:

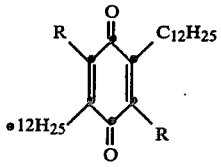

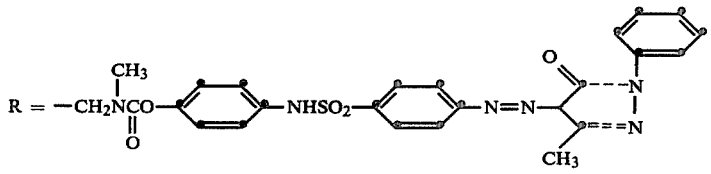

[b]cyan dye

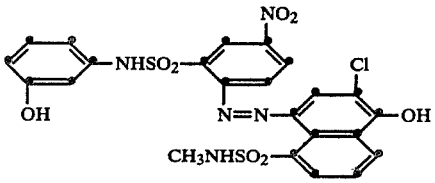

released from BEND Compound II:

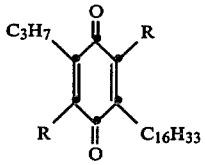

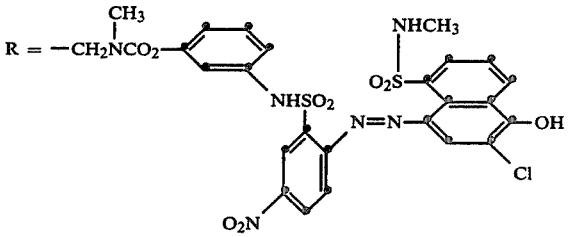

Table 5-continued

| Receiver | Mordant No. | Mordant mg./ft.$^2$ | Mordant Reactive Site | Mordant Charge | Transmission Density and Covalent Bonding (CB): Yellow Dye I$^{(a)}$ $D_{Blue}$ | % CB | Cyan Dye$^{(b)}$ $D_{Red}$ | % CB |
|---|---|---|---|---|---|---|---|---|
| Electron Donor 1 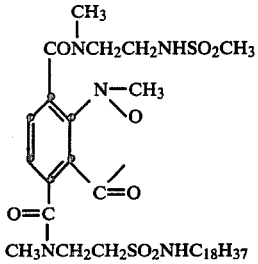 | | | | | | | | |
| Electron Donor 2 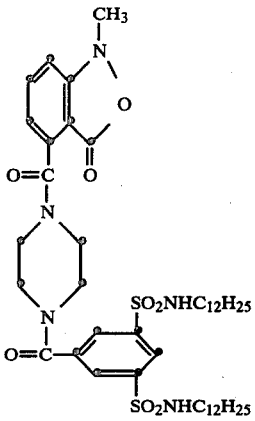 | | | | | | | | |

The invention has been described in detail with particular reference to certain preferred embodiments thereof, but it will be understood that variations and modifications can be effected within the spirit and scope of the invention.

It is claimed:

1. A photographic element comprising a support; a layer comprising silver halide emulsion; and a layer containing non-uniformly and imagewise the reaction product of (a) a photographically useful and/or active fragment having appended thereto a moiety selected from the group consisting of ZNHR, —$SO_2$NHR and

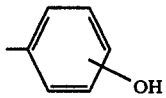

wherein R is H or alkyl and Z is selected from the group consisting of alkylene, arylenealkylene, cycloalkylene and with R can be taken together with the NH to complete an N containing heterocyclic group and (b) a polymeric mordant, wherein said polymer contains recurring units having the formula selected from the group consisting of (1) 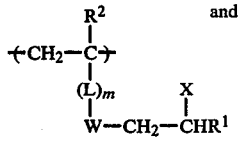 and (2) 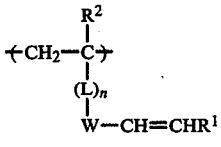

wherein $R^2$ is H or alkyl;

$R^1$ is H, alkyl or aryl;

L is a bivalent linking group providing a linkage between the vinyl group and W selected from the group consisting of alkylene, arylene, arylenealkylene, $COOR^3$ and $CONHR^3$;

$R^3$ is selected from the group consisting of alkylene, arylene and arylenealkylene;

W is an electron withdrawing group selected from the group consisting of $SO_2$, CO,

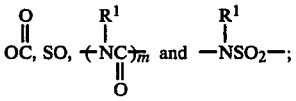

m is 1 or 2;

n is 0 or 1;

with the proviso that when n is O, W is $SO_2$ or

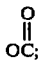

and

X is a leaving group which can be displaced by nucleophiles or eliminated in the form of HX by treatment with base;

wherein said reaction product is formed (a) by displacement of X by said moiety in recurring unit (1), or (b) by addition of said moiety to the double bond of recurring unit (2).

2. The photographic element of claim 1 wherein the silver halide emulsion is in the same layer as the reaction product.

3. The photographic element of claim 2 wherein said photographically useful and/or active fragment is a dye or dye precursor.

4. The photographic element of claim 1 wherein said polymer contains recurring units having the formula selected from the group consisting of:

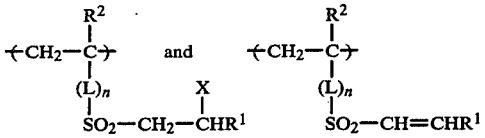

said photographically useful and/or active fragment having appended thereto ZNHR when the polymeric mordant is anionic and said fragment having appended thereto ZNHR, —$SO_2NR$ or

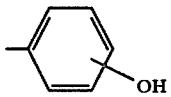

when the polymeric mordant is cationic or nonionic.

5. The photographic element of claim 1 wherein said polymer containing recurring units has the formula selected from the group consisting of

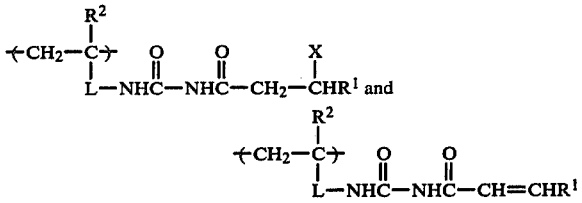

wherein said photographically useful and/or active fragment has appended thereto the moiety ZNHR when the polymeric mordant is cationic or nonionic and said moiety being ZNHR, —$SO_2NHR$ or

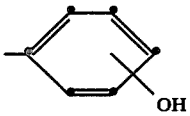

when the polymeric mordant is cationic.

6. The photographic element of claim 1 wherein said polymer is cationic and contains recurring units having the formula selected from the group consisting of

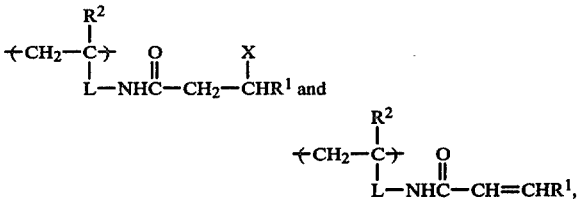

said photographically useful and/or active fragment having appended thereto a ZNHR moiety.

7. The photographic element of claim 1 wherein said photographically useful and/or active fragment is a dye or dye precursor.

* * * * *